United States Patent [19]

Ebner et al.

[11] Patent Number: 4,718,834

[45] Date of Patent: Jan. 12, 1988

[54] METHOD AND APPARATUS FOR CONVEYING GAS

[75] Inventors: Karl Ebner; Stefan Ebner, both of Oberursel/Ts., Fed. Rep. of Germany

[73] Assignee: Ebner & Co. KG Anlagen und Apparate, Fed. Rep. of Germany

[21] Appl. No.: 891,336

[22] Filed: Jul. 31, 1986

[30] Foreign Application Priority Data

Sep. 16, 1985 [DE] Fed. Rep. of Germany ..... 3533017

[51] Int. Cl.[4] ..... F04C 19/00

[52] U.S. Cl. ..... 417/54; 417/68

[58] Field of Search ..... 417/54, 68, 69

[56] References Cited

U.S. PATENT DOCUMENTS

| | | | |
|---|---|---|---|
| 1,991,548 | 2/1935 | De Motte | 417/68 |
| 3,289,918 | 12/1966 | Adams | 417/68 |
| 3,315,879 | 4/1967 | Jennings | 417/54 |
| 3,481,529 | 12/1969 | Mugele | 417/54 |
| 3,954,567 | 5/1976 | Fischer et al. | 417/68 X |
| 3,973,879 | 8/1976 | Ramm | 417/69 |

FOREIGN PATENT DOCUMENTS

| | | | |
|---|---|---|---|
| 2511334 | 9/1976 | Fed. Rep. of Germany | 417/68 |
| 133617 | 10/1979 | Japan | 417/69 |

OTHER PUBLICATIONS

"Siemens-Zeitschrift", 44th annual set, Jun. 1970, vol. 6, pp. 387-392.

"Prospectus E", 216/9/SG 474.32.1/1.74 (2 pages).

*Primary Examiner*—Carlton R. Croyle

*Assistant Examiner*—Paul F. Neils

*Attorney, Agent, or Firm*—Lowe, Price, LeBlanc, Becker & Shur

[57] ABSTRACT

A continuous flow of cooling liquid is provided to a liquid ring pump conveying a flow of gas, such that the cooling liquid simultaneously acts as the working liquid in the pump. Gas that becomes dissolved in the cooling fluid during pumping is separated therefrom and is returned to join the pump gas inlet flow, and the cooling liquid is thereafter discharged to carry away any heat picked up from the pump. In an aspect of this invention, the degassing of dissolved gas from the exhaust cooling water flow leaving the pump is facilitated by forming a spray in a low-pressure degasser connected to the pump gas inlet.

11 Claims, 1 Drawing Figure

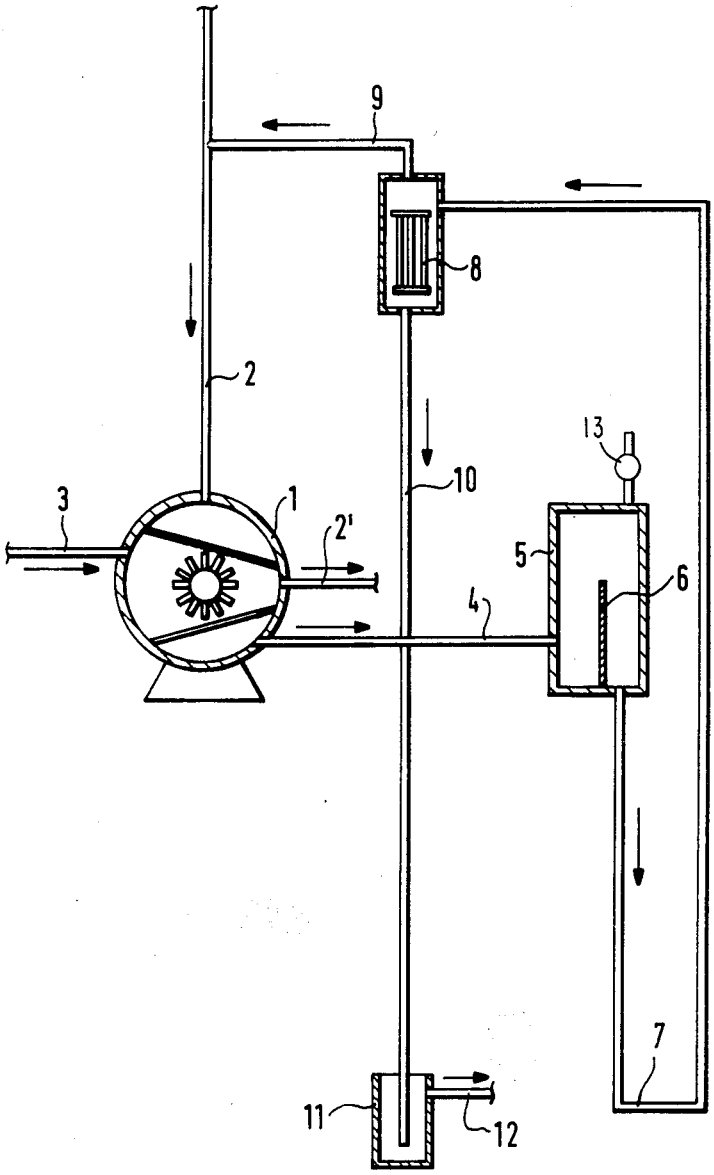
9
8
2
13
10
3
1
2'
5
6
4
7
11
12

METHOD AND APPARATUS FOR CONVEYING GAS

BACKGROUND OF THE INVENTION

1. Field of the Invention

This invention relates to a process for conveying gas by means of a liquid ring pump. The invention also relates to an apparatus for carrying out said process.

2. History of the Prior Art

Liquid ring pumps are often used for conveying gas, particularly chemically reactive gases and vapors. Such pumps are self-aspirating pumps which are normally displacement-type pumps when they are used for conveying gas. A bucket wheel eccentrically mounted within a pump housing with one side of it coming quite close to the inner wall of the pump housing centrifugally forces the functional fluid in the pump housing to the inner wall of the pump housing, resulting in the formation of a substantially concentric fluid ring whereby the single cells of the bucket wheel are effectively sealed off with respect to each other in a radial direction. Hollow spaces are formed in the single sectors of the bucket wheel. Those hollow spaces create suction and pressure action, respectively, caused by the rotation of the bucket wheel. The intake for the gas is connected with the space under suction whereas the outlet of the pump is connected with the space under pressure.

Liquid ring pumps are typically employed both as vacuum pumps and as compressors, and may be run at high rotational speed.

A principal difficulty in operating such ring pumps is that the gas which is to be conveyed thereby is brought into immediate contact with the functional fluid within the pump, so that the gas or individual components of the gas can be dissolved in substantial amounts in the functional fluid, particularly when the fluid and the gas are under pressure. If this is the case, the liquid ring pump may be separately cooled to reduce gas absorption, i.e., instead of a single functional fluid the system employs a working liquid and a separate cooling liquid. For this purpose, the working liquid is circulated through a surface condenser which is cooled by the cooling liquid, e.g., water.

Under the above mentioned circumstances, the working fluid dissolves the gas to be conveyed until the concentration of gas absorbed reaches a saturation limit which is dependent on the prevailing process parameters. When the saturation limit is reached, no further gas is absorbed by the working liquid.

Another difficulty in connection with the use of liquid ring pumps for conveying gas is that the gas to be conveyed often contains water vapor which can condense in the liquid ring pump during its compression. The amount of condensed water vapor is a function of the temperature of the moist gas to be conveyed at the intake of the pump. Vapors other than water in the gas to be conveyed may also show a similar behavior.

In case a condensate is formed in the liquid ring pump the condensate must be removed continuously from the working liquid. The condensate so removed may contain the conveyed gas or its components, respectively, dissolved in amounts corresponding to saturation conditions. It does not matter whether the working liquid and the condensate are identical compounds, e.g., water, or whether the working liquid and condensate are chemically different compounds which are in partial equilibrium.

The loss of gas caused by the necessary removal of the condensate formed in the surface condenser while the pump is working often is relatively small and, in most cases, tolerable. Thus, if the gas which is to be conveyed is substantially soluble in the working liquid, surface cooling of the working liquid in the liquid ring pump is the method of choice to limit such gas loss with the condensate. However, a disadvantage of this method is the requirement of heat exchange between two liquids separated by a surface condenser, which involves high operating and investment costs.

A further disadvantage of surface cooling of the working liquid is that the amount of gas sucked by the pump is dependent on the temperature of the cooling liquid. The higher the temperature of the cooling liquid is, the lower is the suction power of the liquid ring pump. When a given suction power of the pump must be attained by use of a cooling liquid with a maximum operating temperature which is ordinarily not very low, the liquid ring pump must be large in order to yield the necessary suction power at this maximum temperature of the cooling liquid. In this context, it is important to note that the temperature of the working liquid is about 5° to 10° C. higher when a surface condenser is used than it would be if the pump were cooled directly without the use of a surface condenser by the same amount of cooling liquid. This temperature increase in 5° to 10° C. can correspond to a decrease of the suction power of the liquid ring pump up to almost 25%. Despite such limitations, liquid ring pumps with separate working and cooling liquids have succeeded generally because of the balance of factors involved. An example to illustrate this is presented below:

A spinning bath as used in the manufacturing of rayon staple, is to be degassed in a container under low pressure. In this process, primarily hydrogen sulfide and carbon disulfide are liberated. The liberated gases are sucked off by means of a liquid ring pump with a suction power of 700 to 800 $m^3/h$ at a temperature of about 30° C. and a pressure of 120 mbar. Provided that direct cooling is used, 2 $m^3/h$ cooling water at a temperature of 20° C. would be required in order to cool the liquid ring pump under the above-mentioned conditions. Under those conditions, a stream of cooling water, for direct cooling of the ring pump, when saturated with the gases would dissolve about 4 kg/h carbon disulfide and about 6 kg/h hydrogen sulfide. It is apparent that such a loss of gas cannot be accepted not only in view of the loss of material itself but also due to the contamination of the cooling water thereby.

Despite the mentioned disadvantages in connection with separate circulating of the working liquid and the cooling liquid, the balance of factors speaks for the use of the latter process. Only 30 to 40 kg/h water vapour would condense in the liquid ring pump and have to be removed from the working liquid if the process were run at the same parameters and had the same cooling power as provided by a surface condenser. The mentioned amount of water vapor is a typical value depending on the water content of the gas, the temperature and pressure to which the gas is compressed. 30 to 40 kg/h condensate saturated with carbon disulfide and hydrogen sulfide can dissolve about 60 to 80 g/h carbon disulfide and 90 to 120 g/h hydrogen sulfide. In other words, if one would directly cool the working liquid, in a process for conveying gas which is readily soluble in the working liquid, by means of a liquid ring pump, there is a loss of gas 60 times higher than in a process and apparatus employing a surface condenser that is switched between the working liquid and the cooling liquid. The higher operation and investment costs for the relatively large liquid ring pump and the additional surface condenser, however, can be accepted in view of the above mentioned losses in a process for conveying gas by means of a liquid ring pump which is immediately cooled.

SUMMARY OF THE INVENTION

An object of this invention is to provide a process and apparatus for conveying gas by means of a liquid ring pump which provides the small losses of dissolvable gases as are obtained when the working liquid and the cooling liquid are separated, without the disadvantages of this process, particularly oversizing of the pump because of insufficient utilization of the cooling water.

The invention provides a process for conveying gas by means of a liquid ring pump, in which a cooling liquid is continuously led through the pump and also serves as the working liquid; the cooling liquid leaving the pump is degassed for recovery of dissolved gas before discharging of the cooling liquid and the so recovered gas then is recycled into the convey tubing, i.e., tubing to convey the gas. Furthermore, the invention provides a special liquid ring pump with an intake and outlet for the cooling liquid provided with a degassing apparatus, the intake of which is connected to the outlet of the pump and the gas outlet of which is connected to the convey tubing.

Thus, the invention embodies the concept of not separating the working liquid and cooling liquid in a liquid ring pump for conveying gas but, instead, immediately leading the cooling liquid through the pump, so that the cooling liquid also serves as the working liquid.

According to a preferred embodiment of the invention, it is desirable to vent the cooling liquid leaving the pump in a venting tank and then to convey the cooling liquid to a degassing apparatus to remove dissolved gas therefrom under low pressure, the degassing apparatus being connected to the convey tubing leading to the gas intake of the pump. By this measure, it is possible to recycle the gas separated from the cooling liquid by venting and degassing immediately into the intake of the pump and the convey tubing. Preferably the pump, venting tank, degassing apparatus and the outlet of the degassing apparatus are arranged so as to form a barometrical loop which can be connected to a regulator for regulating the height of the liquid in the venting tank.

DESCRIPTION OF THE DRAWING

The FIGURE is a schematic representation of the inventive apparatus for conveying gas by means of a liquid ring pump.

DESCRIPTION OF THE PREFERRED EMBODIMENT

In the FIGURE, there is shown a liquid ring pump 1 provided with a gas intake 2 and a gas outlet 2' for the compressed gas. A flow of fresh, low temperature, cooling water i.e., non-recirculating is continuously fed into the pump housing via line 3 and exhaust cooling liquid is continuously removed via outlet 4 and conveyed to the venting tank 5. The cooling liquid fed into the pump, in passing through the pump also serves as the working liquid. The venting tank serves the purpose of venting the exhaust cooling water. For this purpose the tank or container 5 is preferably provided with a separation member 6, e.g., a separation wall, the upper edge of which defines the height of the cooling liquid in venting tank 5 while outlet 4 leads into the container below the upper edge of the separation wall 6.

After streaming over separation wall 6, the cooling liquid, thus separated from any air bubbles therein, is conveyed via tubular loop 7 in a degassing apparatus 8 which at its top is connected to the gas intake 2 of liquid ring pump 1 via line 9. The gas liberated in the degassing apparatus under the low pressure effected by pump 1 is conveyed through line 9 back to the conveying tubes 2, 2'. It is possible either to spray the cooling liquid by nozzles in the degassing apparatus 8 or to provide degassing apparatus 8 with trickling means of known type. By such measures, known per se, the cooling water which serves simultaneously as working water can be degassed to values of about 20 mg/l.

Under the previously mentioned operating conditions, i.e., a suction power of the pump of 700 to 800 $m^3/h$, a temperature of 30° C., a pressure of 120 mbar, incoming cooling liquid at 20° C., and a flow of exhaust water of about 2000 l/h removed via line 10 from the degassing apparatus 8, 40 g/h carbon disulfide and 40 g/h hydrogen sulfide are also conveyed into the drainage tank 11 and subsequently into line 12. In other words, it is possible by use of cooling water also serving as a working liquid, according to the process and apparatus of the invention, to have smaller gas losses than in the process wherein cooling liquid and working liquid are separated, without the need of additional energy. Particularly, the energy balance of the apparatus shown in the FIGURE is quite favorable because the exhaust cooling water from degassing apparatus 8 is drained off via fall line 10, to a barometrically arranged container 11 and line 12. Hence the lines 4, 7, 10 are arranged so as to form a closed barometrical loop.

What is claimed is:

1. A process for conveying gas by means of a liquid ring pump, comprising the steps of:

providing an inlet flow of said gas, to be conveyed by said liquid ring pump to a gas outlet connected to gas convey tubing;

providing a continuous flow of a cooling liquid at an inlet temperature to said liquid ring pump through a cooling liquid inlet, said cooling liquid also serving as a working liquid within said liquid ring pump, said cooling liquid thereafter leaving said liquid ring pump through a cooling liquid outlet, at an exhaust liquid temperature and an exhaust pressure with an amount of said conveyed gas dissolved therein;

removing a portion of said dissolved gas from said exhaust cooling liquid flow;

dicharging said cooling liquid flow after removal of dissovled gas therefrom; and flowing said removed dissolved gas to join said inlet flow of gas to be conveyed by said liquid ring pump.

2. A process according to claim 1, wherein the flow of said exhaust cooling liquid leaving said liquid ring pump is led to said degasser by a barometrical loop.

3. A process according to claim 1, including the further step of:

venting the exhaust cooling liquid leaving said liquid ring pump prior to removal of dissolved gas therefrom.

4. A process according to claim 3, wherein said removal of dissolved gas from said exhaust cooling liquid is effected by flowing the same through a low pressure degasser communicating with said inlet flow of said gas flowing into said liquid ring pump.

5. A process according to claim 1, wherein said removal of dissolved gas from said exhaust cooling liquid is effected by flowing the same through a low-pressure degasser communicating with said inlet flow of said gas flowing into said liquid ring pump.

6. A process according to claim 5, wherein the flow of said exhaust cooling liquid leaving said liquid ring pump is led to said degasser by a barometrical loop.

7. A process according to claim 5, wherein:

said flow of exhaust cooling liquid containing dissolved gas is formed into a fine spray in said degasser to facilitate degassing of dissolved gas therefrom.

8. An apparatus for conveying gas, comprising:

a liquid ring pump provided with a gas intake, a gas outlet, a cooling liquid intake and a cooling liquid outlet, whereby a flow of gas and a flow of cooling liquid which also serves as a working liquid are effected through said liquid ring pump by operation thereof; and degassing means connected to said liquid ring pump for receiving said cooling liquid flow from said cooling liquid outlet of said liquid ring pump for degassing of any gas dissolved therein and directing the flow of said removed gas to said gas intake of said liquid ring pump.

9. An apparatus according to claim 8, further comprising venting means for venting said exhaust cooling liquid flowing from said cooling liquid outlet of said liquid ring pump prior to entry of said exhaust cooling liquid into said degassing means.

10. An apparatus according to claim 9, wherein:

said liquid ring pump, said venting means and said degassing means are mutually interconnected so as to form a barometrical loop.

11. An apparatus according to claim 10, wherein said venting means further comprises means for regulating a level of said exhaust cooling liquid flowing therethrough.

* * * * *